US012622562B2

(12) United States Patent
VanTongeren

(10) Patent No.: US 12,622,562 B2
(45) Date of Patent: May 12, 2026

(54) AUTONOMOUS FLOOR CLEANER WITH SCRUBBING BELT

(71) Applicant: BISSELL Inc., Grand Rapids, MI (US)

(72) Inventor: Todd R. VanTongeren, Ada, MI (US)

(73) Assignee: BISSELL Inc., Grand Rapids, MI (US)

( * ) Notice: Subject to any disclaimer, the term of this patent is extended or adjusted under 35 U.S.C. 154(b) by 379 days.

(21) Appl. No.: 18/450,008

(22) Filed: Aug. 15, 2023

(65) Prior Publication Data

US 2024/0057836 A1 Feb. 22, 2024

Related U.S. Application Data

(60) Provisional application No. 63/371,668, filed on Aug. 17, 2022.

(51) Int. Cl.
*A47L 11/40* (2006.01)
*A47L 11/292* (2006.01)

(52) U.S. Cl.
CPC ..... *A47L 11/4047* (2013.01); *A47L 11/292* (2013.01); *A47L 11/4083* (2013.01); *A47L 11/4088* (2013.01); *A47L 2201/06* (2013.01)

(58) Field of Classification Search
CPC .. A47L 11/40; A47L 11/4036; A47L 11/4047; A47L 11/29; A47L 11/292; A47L 11/293; A47L 11/408; A47L 11/4083; A47L 11/4088; A47L 11/24; A47L 2201/00; A47L 2201/06
See application file for complete search history.

(56) References Cited

U.S. PATENT DOCUMENTS 2,088,246 A * 7/1937 Nelson ..... A47L 11/4016 15/51
2,297,107 A * 9/1942 Magnuson ..... A47L 11/4016 15/99
3,128,486 A * 4/1964 Kammann ..... A01D 34/001 15/51

FOREIGN PATENT DOCUMENTS

CN 108836201 A * 11/2018 ..... A47L 11/4069
CN 114468873 A * 5/2022 ..... A47L 11/4061
KR 20150014351 A * 2/2015 ..... A47L 9/28

* cited by examiner

*Primary Examiner* — Carlos A. Rivera
(74) *Attorney, Agent, or Firm* — Quinn IP Law

(57) ABSTRACT

A cleaner employing an agitation cartridge to clean a side surface beyond a reach of other onboard cleaning implements. The cleaner may be an autonomous floor cleaner having a body, a cleaning implement onboard the body operable for cleaning a floor surface, a motorized drive system operable for autonomously moving the body over the floor surface, and a scrubbing belt operable for cleaning the side surface.

17 Claims, 4 Drawing Sheets

AUTONOMOUS FLOOR CLEANER WITH SCRUBBING BELT

CROSS-REFERENCE TO RELATED APPLICATIONS

This application claims the benefit of U.S. Provisional Application No. 63/371,668, filed Aug. 17, 2022, which is hereby incorporated by reference in its entirety.

TECHNICAL FIELD

The present disclosure relates to autonomous cleaners, such as but not necessarily limited to autonomous floor cleaners employing an agitation cartridge to clean surfaces beyond a reach of other cleaning implements.

BACKGROUND

An autonomous cleaner may include a suction nozzle, a mop, or another type of autonomously operable cleaning implement to clean a surface. An autonomously controlled drive mechanism may be coupled with the cleaner to facilitate moving the cleaning implement relative to the surface being cleaned, which in the case of an autonomous floor cleaner may be a floor or other terrain that the cleaner is traveling upon. The cleaner may be autonomously operable with a docking station to facilitate automatically recharging batteries, emptying recovery tanks, refilling supply tanks, switching cleaning implements, and otherwise assisting the cleaner with attending to onboard systems. Aside from the cleaner being dependent on a human operator to perform some minor tasks, like plugging the docking station into a power supply, filling/emptying reservoirs of the docking station, etc., an autonomous floor cleaner may essentially perform its cleaning functions without direct assistance from a human operator.

Some autonomous floor cleaners may be restricted to cleaning surfaces within a relatively limited reach of its cleaning implement. Autonomous floor cleaners, for instance, may include the cleaning implement on an underside of the cleaner and inboard of a pair of wheels included as part of the autonomous drive mechanism. The cleaner, as a result, may be correspondingly limited to cleaning surfaces between the wheels and underneath the cleaner, which may effectively restrict the cleaning to surfaces directly under the cleaner that the wheels can travel upon.

BRIEF SUMMARY

One non-limiting aspect of the present disclosure relates an autonomous floor cleaning having a scrubbing belt operable for autonomously cleaning surfaces beyond the surface travelled upon, and optionally, beyond a reach of an onboard cleaning implement.

Disclosed herein is an autonomous floor cleaner. The autonomous floor cleaner may include a body, a cleaning implement for cleaning a floor surface, a motorized drive system for autonomously moving the body over the floor surface, and an agitation cartridge removably connected to the body and including a belt operable for scrubbing a side surface disposed above the floor surface.

The agitation cartridge may include a motorized belt drive mechanism for moving the belt in a rotational manner relative to the side surface.

The agitation cartridge may include a motorized belt drive mechanism for moving the belt in a back and forth manner relative to the side surface.

The agitation cartridge may include a dispensing system for dispensing a cleaning liquid onto the belt.

The agitation cartridge may include a recovery system for recovering materials from the belt.

The agitation cartridge may include a supply tank for storing the cleaning liquid and a recovery tank for storing the materials.

The agitation cartridge may include a scraper positioned to scrape the materials from the belt.

The autonomous floor cleaner may include a suction source carried by the body to provide a suction force for use with the cleaning implement and the recovery system.

The belt may be operable to move in a closed loop path around a plurality of pulleys included on the agitation cartridge, optionally with the closed loop path including a vertical portion for positioning the belt to scrub the side surface.

The closed loop path may include a horizontal portion for positioning the belt to additionally scrub the floor surface.

The autonomous floor cleaner may include at least two of the pulleys being vertically aligned to define the vertical portion and at least two of the pulleys being horizontally aligned to define the horizontal portion.

The agitation cartridge may include a motorized belt drive mechanism operable to move the belt along the closed loop path.

The belt drive mechanism may include a motor configured to drive at least one of the pulleys, optionally with the driven at least one of the pulleys causing the belt to move along the closed loop path.

The motor may include a gearbox connected to the at least one pulley via a chain or a cable.

The pulleys may include a biasing member operable to move at least part of the vertical portion laterally in and out relative to the side surface.

Disclose herein is an autonomous floor cleaner. The autonomous floor cleaner may include a body, a cleaning implement for cleaning a floor surface, a motorized drive system for autonomously moving the body over the floor surface, and an agitation cartridge including a motorized belt drive mechanism for agitating a first belt to scrub a first surface and a second belt to scrub a second surface, optionally with the first and second surfaces being above the floor surface and outboard of the body beyond a reach of the cleaning implement.

The belt drive mechanism may include a plurality of pulleys arranged to move the first belt along a first closed loop path and the second belt along a second closed loop path, optionally with the first closed loop path including a first side portion for positioning the belt to scrub the first surface and a first floor portion for positioning the belt to scrub the floor surface, and optionally the second closed loop path including a second side portion for positioning the belt to scrub the second surface and a second floor portion for positioning the belt to scrub the floor surface.

The belt drive mechanism may include a first motor for rotating the first belt and a second motor for rotating the second belt, the first and second motors being independently operable to separately control rotation of the first and second belts.

The agitation cartridge may include a dispensing system for dispensing a cleaning liquid onto the belt, a recovery system for recovering materials from the belt, a supply tank for storing the cleaning liquid, and a recovery tank for storing the materials.

Disclosed herein is an autonomous floor cleaner. The autonomous floor cleaner may include a body, a plurality of wheels for moving the body over a floor surface, a motorized drive system carried for autonomously moving the body over of the floor surface, a suction source to provide a suction force, a suction nozzle fluidly coupled with the suction source and the suction nozzle being operable with the suction force to recover debris from the floor surface, and an agitation cartridge for scrubbing a side surface. The agitation cartridge may include a motorized belt drive mechanism for agitating a scrubbing belt to scrub the side surface, a supply tank for storing a cleaning liquid, a dispensing system for dispensing the cleaning liquid onto the belt, a recovery system for recovering debris from the belt, and a recovery tank for storing the debris recovered through the recovery system and the suction nozzle.

The above features and advantages along with other features and advantages of the present teachings are readily apparent from the following detailed description of the modes for carrying out the present teachings when taken in connection with the accompanying drawings. It should be understood that even though the following Figures and embodiments may be separately described, single features thereof may be combined to additional embodiments.

BRIEF DESCRIPTION OF THE DRAWINGS

The accompanying drawings, which are incorporated into and constitute a part of this specification, illustrate implementations of the disclosure and together with the description, serve to explain the principles of the disclosure.

DETAILED DESCRIPTION

As required, detailed embodiments of the present disclosure are disclosed herein; however, it is to be understood that the disclosed embodiments are merely exemplary of the disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
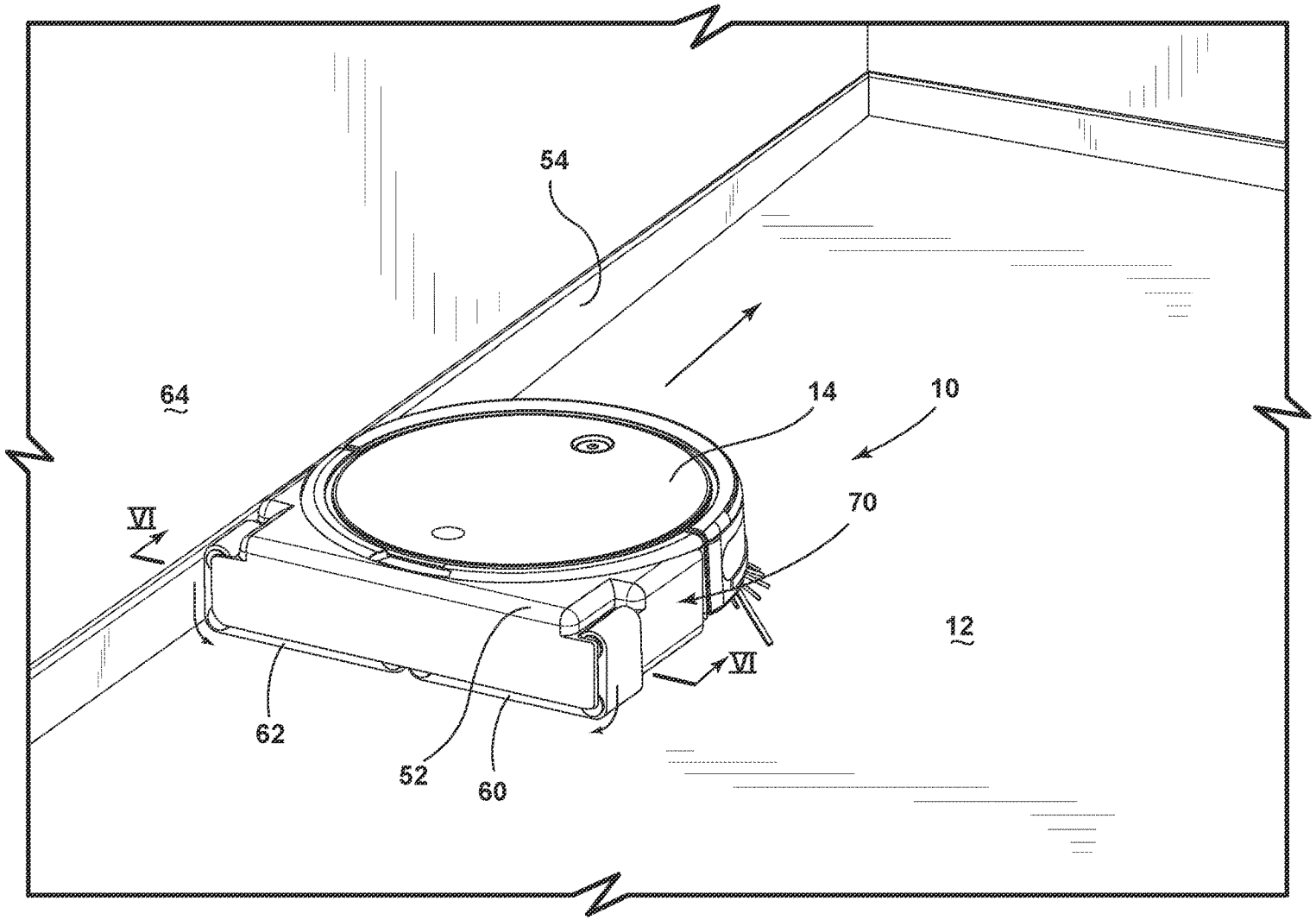
FIG. 1 illustrates a top perspective view of a cleaner in accordance with one non-limiting aspect of the present disclosure.

FIG. 1 illustrates a top perspective view of a cleaner 10 in accordance with one non-limiting aspect of the present disclosure. The cleaner 10 is described for exemplary purposes with respect to being configured as an autonomous or robotic type of cleaner operable to autonomously clean while being autonomously driven upon a surface 12, which in the case of an autonomous floor cleaner may be a floor surface or other terrain. Aside from the cleaner 10 being dependent on a human operator to perform some minor tasks, the autonomous functionality of the cleaner 10 may generally correspond with operations the cleaner 10 is capable of performing according to logic, sensors, feedback, and/or computerized controls implemented without corresponding assistance from a human operator. The cleaner 10, for instance, may be configured to clean and move around a room or other environment without an operator having to remotely control, physical push, or otherwise personally direct the attendant activities. To this end, the cleaner 10 may include corresponding sensors, controllers, mechanisms, motors, etc. operable to move the cleaner 10 autonomously around an environment while autonomously performing various cleaning tasks.

Figure 2:
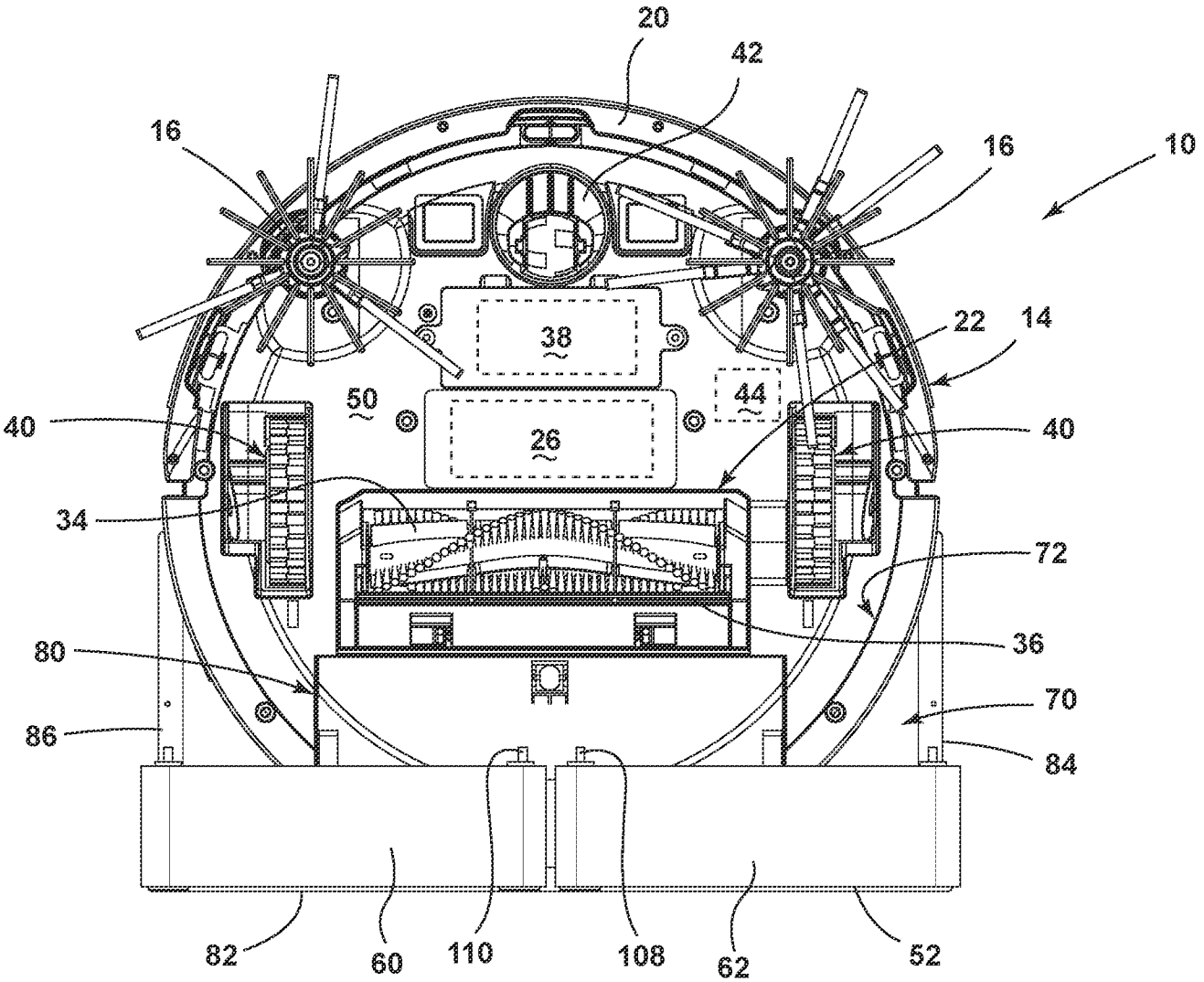
FIG. 2 illustrates a bottom perspective view of the cleaner in accordance with one non-limiting aspect of the present disclosure.

FIG. 2 illustrates a bottom perspective view of the cleaner 10 in accordance with one non-limiting aspect of the present disclosure. The cleaner 10 may include a body 14 configured in accordance with the housing described in U.S. patent application Ser. No. 17/007,450, filed Aug. 31, 2020, entitled Edge Cleaning Brushes for Floor Cleaner, the disclosure of which is hereby incorporated in its entirety by reference herein. The body 14 may similarly include or otherwise be coupled with a pair of edge cleaning brushes 16, a bumper 20, a suction nozzle 22, a suction source 26, a brushroll 34, a wiper blade 36, an electrical rechargeable power source 38, a motorized drive system for a pair of wheels 40, a caster 42, a controller 44, and/or the various functional systems described in the incorporated patent application. The controller 44 may facilitate the controls and other operations described herein, which may include a processor associated with the controller 44 executing according to a corresponding plurality of non-transitory instructions stored on a related computer storage medium. These features are highlighted for descriptive purposes as representative of some of the elements commonly employed with an autonomous or robotic infrastructure to facilitate moving cleaners over the floor surface 12. The present disclosure fully contemplates the body 14 having other configurations, including capabilities for using propulsion mechanisms in addition to or in place of the motorized wheels 40.

The illustrated body 14, as one skilled in the art will appreciate, may include the suction nozzle 22 or other cleaning implement disposed on an underside 50 to clean beneath the body 14 as the body 14 is driven across the floor surface 12, e.g., a suction force generated with the suction source 26 may be used to collect debris, liquids, and/or a combination thereof though the suction nozzle 22. The positioning of the suction nozzle 22 on the underside 50 may effectively limit the suction nozzle 22 to cleaning portions of the floor surface 12 between the wheels 40 that the wheels 40 are capable of traversing. The edge cleaning brushes 16 may be helpful in expanding the cleaning area to portions within the reach thereof, i.e., the brushes 16 may pull debris in towards to the suction nozzle 22 for recovery. Even with this type of additional cleaning implement, the surfaces capable of being cleaned with the suction nozzle 22 may effectively be limited to the floor surface 12 upon which the wheels 40 can travel. One non-limiting aspect of the present disclosure contemplates an agitation cartridge 52 operable to advantageously enable the cleaner 10 to clean additional surfaces 54 beyond the surfaces 12 upon which the wheels 40 can travel and/or beyond the reach of the edge cleaning brushes 16.

Returning to FIG. 1, the agitation cartridge 52 may include a pair of scrubbing belts 60, 62 operable to scrub, mop, or otherwise clean additional surfaces beyond the cleaning reach of the other, onboard cleaning implements, i.e., the suction nozzle 22 and/or the edge cleaning brushes 16 onboard the body 14. One such additional surface 54 is shown to correspond with a baseboard type of trim molding positioned for covering a lower portion of an interior wall 64 surrounding the floor surface 12. The additional surface 54 is shown to generally correspond with a side surface having a relatively perpendicular orientation to the floor surface 12 and parallel orientation to a side portion 66 (see FIG. 4) of the cartridge 52. Alternatively, surface 54 can be the kick-space commonly found in kitchen environments and includes lower cabinet baseboards and similar kick panels on dishwashers and refrigerators. The side surface 54 is shown and described as being illustrative of an additional surface beyond the reach of the edge brushes 16 and/or the suction nozzle 22 capable of being cleaned with the scrubbing belts 60, 62 as the present disclosure fully contemplates its use and application in cleaning additional surfaces, such as, for instance, additional surfaces beyond of the body 14 associated with table legs, cabinetry, boards, doors, etc. that may be disposed on top of or extend relative to the floor surface 12.

The surfaces 54 capable of being cleaned with the scrubbing belts 60, 62 may optionally be limited to those within a range of the cleaner 10 or other surfaces within areas of the floor surface 12 relative to which the cleaner 10 is capable of positioning the scrubbing belts 60, 62 to engage. The cartridge 52, accordingly, may be beneficially used to scrub and clean other types of surfaces besides those associated with walls 64 adjoining the floor surface 12. The illustrated cleaning of the baseboard (side surface) 54 is predominantly described to demonstrate one type of surface some autonomous floor cleaners have previously been unable to adequately clean due to the surfaces being disposed above the floor surface 12 or otherwise beyond an effective reach of other onboard cleaning implements. The cleaner 10 disclosed herein is believed to be particularly beneficial when deployed within a home environment to autonomously clean floors, carpets, etc., particularly due to those areas in a home typically including the baseboard, a kickspace, or a similar type of bordering structure to define a perimeter of the cleanable area.

Figure 3:
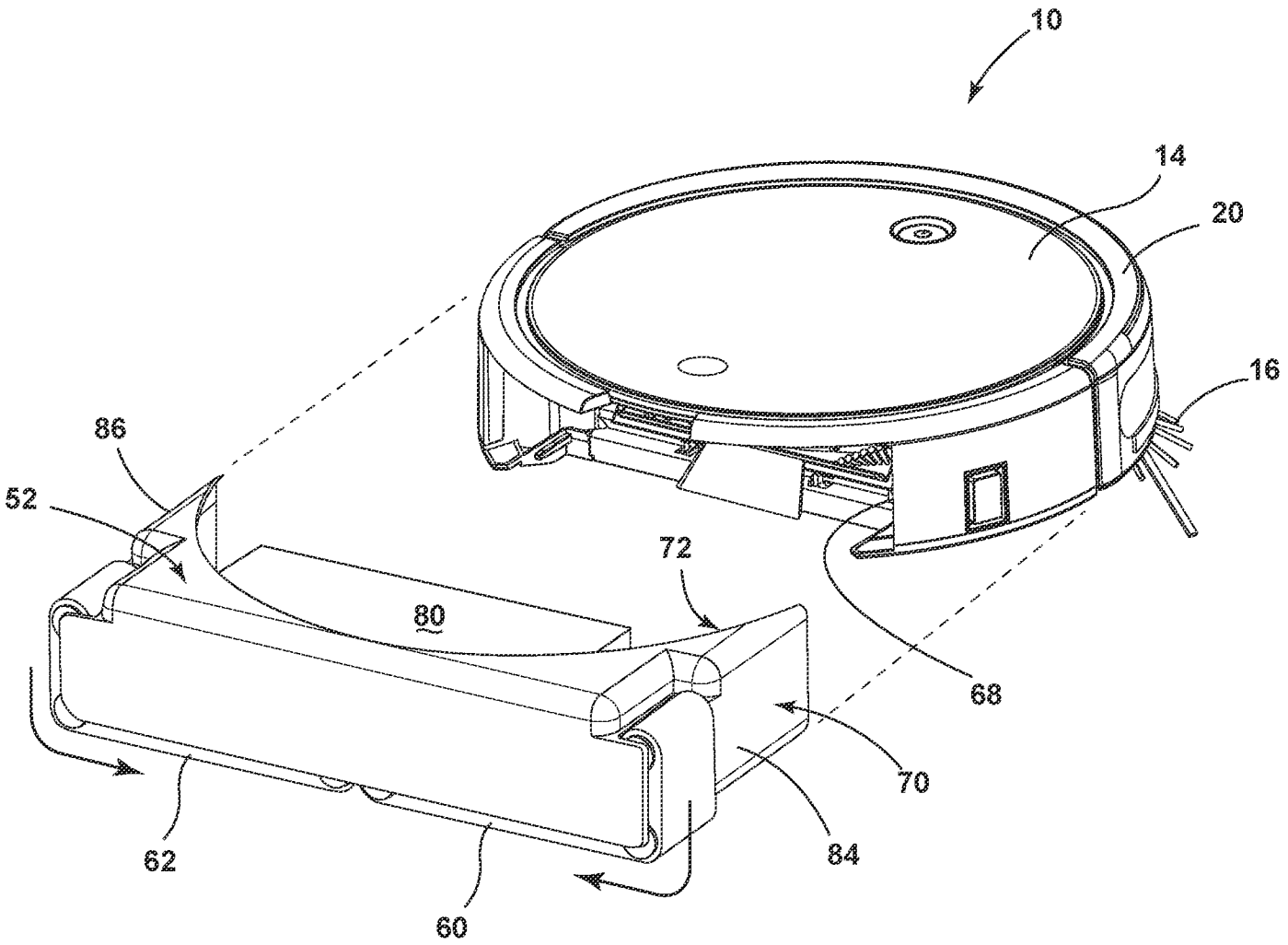
FIG. 3 illustrates an assembly view of the cleaner accordance with one non-limiting aspect of the present disclosure.

FIG. 3 illustrates an assembly view of the cleaner 10 accordance with one non-limiting aspect of the present disclosure. The agitation cartridge 52 may be configured to be removably coupled with or otherwise connect to the body 14, such as through clips, latches, or other features included within a receptacle 68 on the body 14. The agitation cartridge 52 may be interchangeable with the collection bin included in the incorporated patent application Ser. No. 17/007,450, at least in so far as being configured as a drop-in replacement capable of being inserted in the same manner as the collection bin. The agitation cartridge 52 may be slightly larger and include a different housing 70 structure for enclosing its componentry. The housing 70 may include a curvilinear shaped portion 72 configured to nest with a corresponding shape of the body 14, which is shown to include a generally circular perimeter. The circular and curvilinear shaping of the housing 70 and the body 14 is exemplary as the present disclosure fully contemplates the body 14 including other configurations and the housing 70 being correspondingly shaped to be removably connected thereto, including the D-shaped configuration common to other types of autonomous floor cleaners, such as that described in U.S. patent application Ser. No. 16/833,733, filed Mar. 30, 2020, entitled Autonomous Floor Cleaner with Drive Wheel Assembly, the disclosure of which is hereby incorporated in its entirety by reference herein.

The housing 70 may correspond with a relatively rigid material, such as plastic and/or aluminum, having a size and shape configured to facilitate positioning the scrubbing belts 60, 62 slightly outboard of opposed sides 76, 78 of the body 14. The housing 70 may optionally include a top half and a bottom half clipped or otherwise fastened together to provide a support structure for the scrubbing belts 60, 62 and other componentry described herein. The agitation cartridge 52 is shown to fit within the receptacle 68 in the illustrated manner so as to facilitate positioning a tank system 80 within a working airstream associated with the suction force generated with the suction source 26, e.g., the tank system 80 may be fluidly coupled with the suction nozzle 22, etc. onboard the body 14 to facilitate communicating debris, liquid, etc. recovered therewith to the tank system 80. A rearward end 82 (see FIG. 2) of the agitation cartridge 52 may be generally perpendicular to a pair of opposed sidewalls 84, 86, with the sidewalls 84, 86 optionally extending rearwardly from a rear end of the body 14 to a location slightly short of the bumper 20 to provide a movement gap for the bumper 20 when contacting an obstruction.

Figure 4:
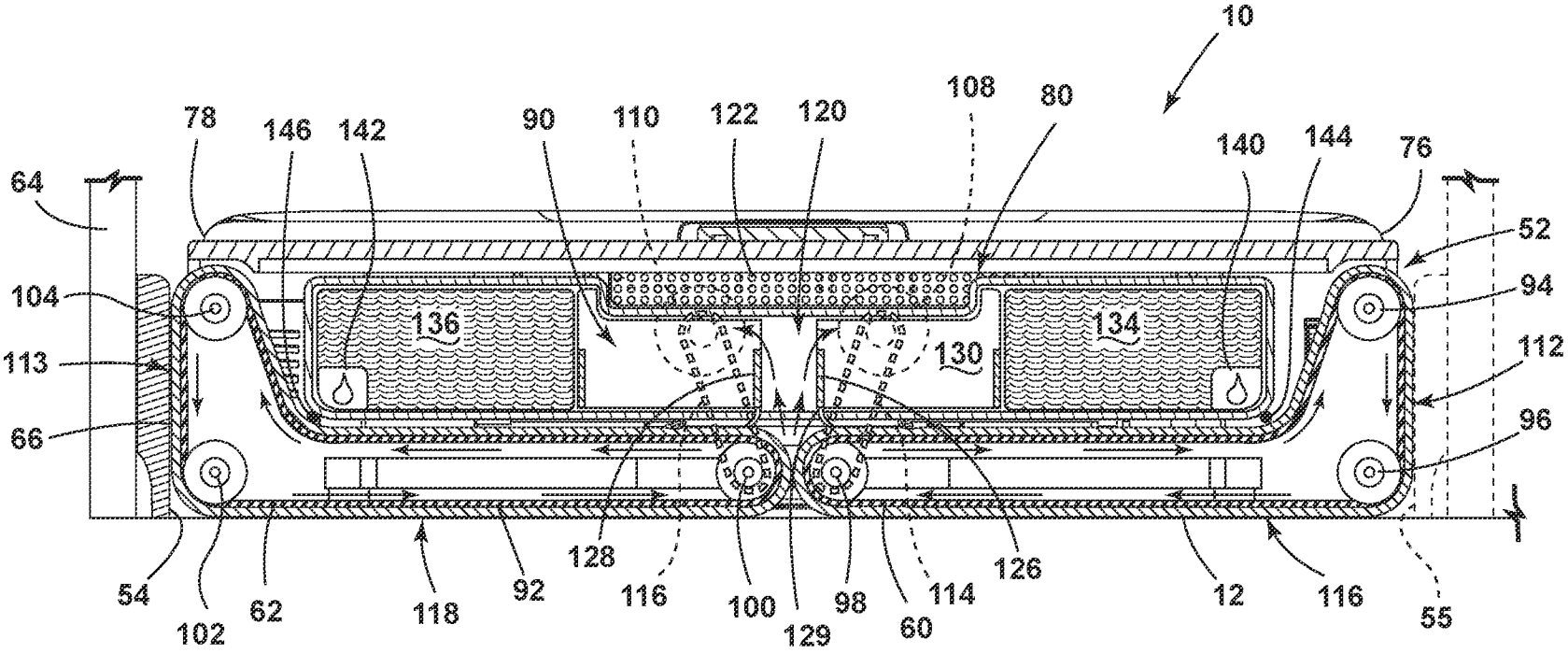
FIG. 4 illustrates a schematic cross-sectional view of the cleaner in accordance with one non-limiting aspect of the present disclosure.

FIG. 4 illustrates a schematic cross-sectional view of the cleaner 10 in accordance with one non-limiting aspect of the present disclosure. The agitation cartridge 52 may include a motorized belt drive mechanism 90 operable for moving the scrubbing belts 60, 62 in a rotational and/or a back and forth manner to facilitate scrubbing the baseboard 54 the first belt 60 and a second or another side surface 55 with the second belt 62. The scrubbing belts 60, 62 may optionally include a rubber or other flexible structural backing 92 or other embedded support and be comprised of a fabric, microfiber, or other material suitable for scrubbing type of cleaning tasks. The motorized belt drive mechanism 90 is described for exemplary purposes with respect to rotating the scrubbing belts 60, 62 in a closed loop path relative to a plurality of pulleys 94, 96, 98, 100, 102, 104. The motorized belt drive mechanism 90 may include a pair of motors 108, 110, optionally having gearboxes or other gearing, configured to actuate a drive chain or cable 114, 116 connected to one or more of the pulleys 94, 96, 98, 100, 102, 104, which is shown for exemplary purposes as corresponding with a pair of cables 114, 116 connected to a pair of driven pulleys 98, 100. The pulleys 94, 96, 98, 100, 102, 104 may be under tension, friction, or other engagement with the scrubbing belts 60, 62, e.g., a tooth drive, to facilitate moving the scrubbing belts 60, 62 relative to the pulleys 94, 96, 98, 100, 102, 104 in response to actuation of the driven pulleys 98, 100.

The pulleys 94, 96, 98, 100, 102, 104 may be configured to rotate about a central axles or shaft, with the shaft of the driven pulleys 98, 100 being forcibly rotatable with the motors 108, 110 and the shafts of the non-driven pulleys 94, 96, 102, 104 being freely rotatable or free spinning. The pulleys 94, 96, 98, 100, 102, 104 are generally shown to rotate relative to an inside of the scrubbing belts 60, 62 for exemplary purposes as additional pulleys may be included to facilitate further constraining or directing movements of the scrubbing belts 60, 62, including positioning of pulleys on an outside of the scrubbing belts 60, 62. The described pair of scrubbing belts 60, 62 may be beneficial in facilitating independent movement relative to different halves of the cleaner 10 and to provide the additional controllability described below. The present disclosure, nonetheless, fully contemplates the use of additional scrubbing belts 60, 62, such as two or more belts 60, 62 operating side-by-side, and/or a singular scrubbing belt, such as a single scrub belt spanning from a side to an opposite side of the agitation cartridge 52. The pulleys 94, 96, 98, 100, 102, 104 may be arranged in the illustrated manner such that a vertically aligned pair of the pulleys (e.g., pair 94, 96 and pair 102, 104) define vertical or side portions 112, 113 of the closed loop path and a horizontally aligned pair of the pulleys (e.g., pair 96, 98 and pair 100, 102) define horizontal or bottom portions 116, 118 of the closed loop path.

The pulleys 94, 96, 98, 100, 102, 104 may be arranged in a fixed relationship whereby the axles are immovably fixed to the housing 70, which may be beneficial in reliably securing attachment to the housing 70 and corresponding positioning of the scrubbing belts 60, 62 to clean the contacted surfaces. The pulleys 94, 96, 98, 100, 102, 104 may optionally include static biasing members, such as springs or rubber bands, and/or articulating or moveable biasing members, such as pistons or actuating arms, to facilitate individually positioning the pulleys. The vertically arranged pulleys 96, 96, 102, 104 may be controllable to press against or otherwise adapt to a surface of the baseboard 54, i.e., the move laterally in and out to match a shape of the baseboard 54. One or more additional pulleys (not shown) may optionally be included to selectively press against or retract from a middle of the side portions 112, 113 to assist in conforming to a shape of the scrubbing belts 60, 62 to match an outline or topology of the baseboard 54. The horizontally arranged pulleys may also be controllable to lift or raise the horizontal portion 116, 118, for example to adapt to carpets or other protuberances on the floor surface 12, and/or move outwardly or inwardly to adjust the tension of the belts 60, 62, for example to accommodate changes in the shape of the side portions 112, 113.

The motorized belt drive mechanism 90 may be configured to rotate the scrubbing belts 60, 62 in opposite directions around the closed loop path according to the arrowed directions. The belt drive mechanism 90 may also be autonomously controllable to perform other types of scrubbing agitation, such as by moving the belts 60, 62 back and forth or otherwise moving the belts 60, 62 in concert with movement of the cleaner 10, e.g., rotating the belts 60, 62 when stationary and moving the belts 60, 62 back and forth when the cleaner 10 is moving, or some combination thereof. The ability to adapt movement of the scrubbing belts 60, 62 to movement of the cleaner 10 may be beneficial in tailoring the related scrubbing action to desired cleaning activities. The motors 108, 110 may be independently controllable to facilitate the desired agitation, including being selectively controllable to independently move the scrubbing belts 60, 62 in the same or different directions. The movement of the scrubbing belts 60, 62 may optionally be coordinated with movements of the wheels 40 to facilitate steering of the cleaner 10, e.g., one of the scrubbing belts 60, 62 may be driven while the other is undriven and/or driven in an opposite direction to provide a tighter turn radius or otherwise influence maneuverability of the robot.

The scrubbing belts 60, 62 may be actuated in the illustrated manner to direct debris, liquid, etc. toward a middle of the agitation cartridge 52. This movement may be beneficial in facilitating mopping or sweeping action whereby the materials recovered with the side and bottom portions of the belt can be directed inwardly for recovery with a focused suction feature 120. The focused suction feature 120 may be connected by a conduit 122 to the working air path and/or the suction source 26 to facilitate drawing material away from the scrubbing belts 60, 62 for storage recovery within the tank system 80. A pair of scrapers 126, 128 may be disposed relative to the scrubbing belts 60, 62 proximate to an opening 129 of the tank system 80 to facilitate scraping or otherwise physically removing materials from the scrubbing belts 60, 62. The material removed from the scrubbing belts 60, 62 may be stored within a recovery tank 130 of the tank system 80, which may also be configured to store materials recovered with the suction nozzle 22 or other cleaning implement on the body 14. The recovery tank 130, accordingly, may form part of a recovery system operable with the focused suction feature 120, the scrapers 126, 128, the suction source 26, the suction nozzle 22, and/or other components to facilitate storing debris, liquid, etc. recovered within the cleaner 10.

The recovery tank 130 may optionally cooperate with a pair of supply tanks 134, 136 additionally included as part of the tank system 80. The supply tanks 134, 136 may be configured to retain a cleaning liquid (e.g., water, cleaning solution, and/or a combination thereof) used to facilitate cleaning surfaces with the scrubbing belts 60, 62. The supply tanks 134, 136 may be operable with a dispensing system 140, 142 for dispensing the cleaning liquid onto the belts 60, 62. The dispensing systems 140, 142 are shown for exemplary purposes as including drip valves or other fluid dispensers integrated with a roller 144, 146 whereby the roller 144, 146 may be used to direct movement of the scrubbing belts 60, 62 and the dispensers 144, 146 may be electronically controlled to drip the cleaning liquid through perforations, etc. for application to the belts 60, 62, optionally across an entire width of the scrubbing belts 60, 62. The dispensers 144, 146 may cooperate with an aperture other feature in the supply tanks 134, 136 to facilitate spreading the cleaning liquid.

The rollers 144, 146 may be positioned as illustrated at an elbow of the scrubbing belts 60, 62 to facilitate applying the cleaning liquid after the previously applied cleaning liquid has been scraped and removed through the focused suction feature 120 and just prior to the scrubbing belts 60, 62 engaging the side surface 54. The dispensers 144, 146 may optionally be independently controllable to facilitate selectively applying the cleaning liquid to one or both of the scrubbing belts 60, 62 depending on whether the scrubbing belts 60, 62 are actively scrubbing a side surface, e.g., the dispensing of the cleaning liquid may be limited to the left scrubbing belt 62 when engaging the side surface 54 when the right scrubbing belt 60 is disengaged from or otherwise not scrubbing a corresponding side surface or other surface beyond the reach of the other cleaning implements. The recovery tank 130 may optionally be automatically disposed of or removed by the docking station when docked, and the supply tanks 134, 136 may optionally be automatically re-filled by the docking station when docked.

The following Clauses provide example configurations of an autonomous air cleaner disclosed herein.

Clause 1. An autonomous floor cleaner, comprising: a body; a cleaning implement for cleaning a floor surface; a motorized drive system for autonomously moving the body over the floor surface; and an agitation cartridge removably connected to the body, the agitation cartridge including a belt operable for scrubbing a side surface disposed above the floor surface.

Clause 2. The autonomous floor cleaner according to clause 1 wherein the agitation cartridge includes a motorized belt drive mechanism for moving the belt in a rotational manner relative to the side surface.

Clause 3. The autonomous floor cleaner according to clause 1 wherein the agitation cartridge includes a motorized belt drive mechanism for moving the belt in a back and forth manner relative to the side surface.

Clause 4. The autonomous floor cleaner according to any of clauses 1-3 wherein the agitation cartridge includes a dispensing system for dispensing a cleaning liquid onto the belt.

Clause 5. The autonomous floor cleaner according to any of clauses 1-4 wherein the agitation cartridge includes a recovery system for recovering materials from the belt.

Clause 6. The autonomous floor cleaner according to any of clauses 1-5 wherein the agitation cartridge includes a supply tank for storing the cleaning liquid and a recovery tank for storing the materials.

Clause 7. The autonomous floor cleaner according to any of clauses 1-6 wherein the agitation cartridge includes a scraper positioned to scrape the materials from the belt.

Clause 8. The autonomous floor cleaner according to any of clauses 1-7 further comprising a suction source carried by the body to provide a suction force for use with the cleaning implement and the recovery system.

Clause 9. The autonomous floor cleaner according to any of clauses 1-8 wherein the belt is operable to move in a closed loop path around a plurality of pulleys included on the agitation cartridge, the closed loop path including a vertical portion for positioning the belt to scrub the side surface.

Clause 10. The autonomous floor cleaner according to clause any of clauses 1-9 wherein the closed loop path includes a horizontal portion for positioning the belt to additionally scrub the floor surface.

Clause 11. The autonomous floor cleaner according to clause 10 wherein at least two of the pulleys are vertically aligned to define the vertical portion and at least two of the pulleys are horizontally aligned to define the horizontal portion.

Clause 12. The autonomous floor cleaner according to any of clauses 1-9 wherein the agitation cartridge includes a motorized belt drive mechanism operable to move the belt along the closed loop path.

Clause 13. The autonomous floor cleaner according to any of clauses 1-12 wherein the belt drive mechanism includes a motor configured to drive at least one of the pulleys, the driven at least one of the pulleys causing the belt to move along the closed loop path.

Clause 14. The autonomous floor cleaner according to any of clauses 1-13 wherein the motor includes a gearbox connected to the at least one pulley via a chain or a cable.

Clause 15. The autonomous floor cleaner according to any of clauses 1-9 wherein at least one of the pulleys includes a biasing member operable to move at least part of the vertical portion laterally in and out relative to the side surface.

Clause 16. An autonomous floor cleaner, comprising: a body; a cleaning implement for cleaning a floor surface; a motorized drive system for autonomously moving the body over the floor surface; and an agitation cartridge including a motorized belt drive mechanism for agitating a first belt to scrub a first surface and a second belt to scrub a second surface, the first and second surfaces being above the floor surface and outboard of the body beyond a reach of the cleaning implement.

Clause 17. The autonomous floor cleaner according to clause 16 wherein the belt drive mechanism includes a plurality of pulleys arranged to move the first belt along a first closed loop path and the second belt along a second closed loop path, the first closed loop path including a first side portion for positioning the belt to scrub the first surface and a first floor portion for positioning the belt to scrub the floor surface, the second closed loop path including a second side portion for positioning the belt to scrub the second surface and a second floor portion for positioning the belt to scrub the floor surface.

Clause 18. The autonomous floor cleaner according to any of clauses 16-17 wherein the belt drive mechanism includes a first motor for rotating the first belt and a second motor for rotating the second belt, the first and second motors being independently operable to separately control rotation of the first and second belts.

Clause 19. The autonomous floor cleaner according to any of clauses 1-18 wherein the agitation cartridge includes a dispensing system for dispensing a cleaning liquid onto the belt, a recovery system for recovering materials from the belt, a supply tank for storing the cleaning liquid, and a recovery tank for storing the materials.

Clause 20. An autonomous floor cleaner, comprising: a body; a plurality of wheels for moving the body over a floor surface; a motorized drive system carried for autonomously moving the body over of the floor surface; a suction source to provide a suction force; a suction nozzle fluidly coupled with the suction source, the suction nozzle operable with the suction force to recover debris from the floor surface; and an agitation cartridge for scrubbing a side surface, the agitation cartridge including: a motorized belt drive mechanism for agitating a scrubbing belt to scrub the side surface; a supply tank for storing a cleaning liquid; a dispensing system for dispensing the cleaning liquid onto the belt; a recovery system for recovering debris from the belt; and a recovery tank for storing the debris recovered through the recovery system and the suction nozzle.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. "A", "an", "the", "at least one", and "one or more" are used interchangeably to indicate that at least one of the items is present. A plurality of such items may be present unless the context clearly indicates otherwise. All numerical values of parameters (e.g., of quantities or conditions), unless otherwise indicated expressly or clearly in view of the context, including the appended claims, are to be understood as being modified in all instances by the term "about" whether or not "about" actually appears before the numerical value. A component that is "configured to" perform a specified function is capable of performing the specified function without alteration, rather than merely having potential to perform the specified function after further modification. In other words, the described hardware, when expressly configured to perform the specified function, is specifically selected, created, implemented, utilized, programmed, and/or designed for the purpose of performing the specified function.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims. Although several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A floor cleaner, comprising:

a body;

a cleaning implement connected to the body and configured for cleaning a floor surface; and an agitation cartridge removably connected to the body, the agitation cartridge including a belt operable for scrubbing a side surface disposed above the floor surface;

wherein the belt is operable to move in a closed loop path around a plurality of pulleys included on the agitation cartridge, the closed loop path including a vertical portion for positioning the belt to scrub the side surface; and wherein at least one of the pulleys includes a biasing member operable to move at least part of the vertical portion laterally in and out relative to the side surface.

2. The floor cleaner according to claim 1 wherein the agitation cartridge includes a motorized belt drive mechanism for moving the belt in a rotational manner relative to the side surface.

3. The floor cleaner according to claim 1 wherein the agitation cartridge includes a motorized belt drive mechanism for moving the belt in a back and forth manner relative to the side surface.

4. The floor cleaner according to claim 1 wherein the agitation cartridge includes a drip valve for dispensing a cleaning liquid onto the belt.

5. The floor cleaner according to claim 4 wherein the agitation cartridge includes a recovery system for recovering materials from the belt.

6. The floor cleaner according to claim 5 wherein the agitation cartridge includes a supply tank for storing the cleaning liquid and a recovery tank for storing the materials.

7. The floor cleaner according to claim 6 wherein the agitation cartridge includes a scraper positioned to scrape the materials from the belt.

8. The floor cleaner according to claim 5 further comprising a suction source carried by the body to provide a suction force for use with the cleaning implement and the recovery system.

9. The floor cleaner according to claim 1 wherein the closed loop path includes a horizontal portion for positioning the belt to additionally scrub the floor surface.

10. The floor cleaner according to claim 9 wherein at least two of the pulleys are vertically aligned to define the vertical portion and at least two of the pulleys are horizontally aligned to define the horizontal portion.

11. The floor cleaner according to claim 1 wherein the agitation cartridge includes a motorized belt drive mechanism operable to move the belt along the closed loop path.

12. The floor cleaner according to claim 11 wherein the belt drive mechanism includes a motor configured to drive at least one of the pulleys, the driven at least one of the pulleys causing the belt to move along the closed loop path.

13. The floor cleaner according to claim 12 wherein the motor includes a gearbox connected to the at least one pulley via a chain or a cable.

14. A floor cleaner, comprising:

a body;

a cleaning implement connected to the body and configured for cleaning a floor surface; and an agitation cartridge including a motorized belt drive mechanism configured for agitating a first belt to scrub a first surface and a second belt to scrub a second surface, the first and second surfaces being above the floor surface and outboard of the body beyond a reach of the cleaning implement;

wherein the belt drive mechanism includes a plurality of pulleys arranged to move the first belt along a first closed loop path and the second belt along a second closed loop path, the first closed loop path including a first side portion for positioning the first belt to scrub the first surface and a first floor portion for positioning the first belt to scrub the floor surface, the second closed loop path including a second side portion for positioning the second belt to scrub the second surface and a second floor portion for positioning the second belt to scrub the floor surface.

15. The floor cleaner according to claim 14 wherein the belt drive mechanism includes a first motor for rotating the first belt and a second motor for rotating the second belt, the first and second motors being independently operable to separately control rotation of the first and second belts.

16. The floor cleaner according to claim 14 wherein the agitation cartridge includes a drip valve for dispensing a cleaning liquid onto the belt, a recovery system for recovering materials from the belt, a supply tank for storing the cleaning liquid, and a recovery tank for storing the materials.

17. A floor cleaner, comprising:

a body;

a plurality of wheels configured for moving the body over a floor surface;

a suction source configured for providing a suction force;

a suction nozzle fluidly coupled with the suction source, the suction nozzle operable with the suction force to recover debris from the floor surface; and an agitation cartridge configured for scrubbing a side surface, the agitation cartridge including:

a motorized belt drive mechanism configured for agitating a scrubbing belt to scrub the side surface;

a supply tank configured for storing a cleaning liquid;

a drip valve configured for dispensing the cleaning liquid onto the belt;

a recovery system configured for recovering debris from the belt; and a recovery tank configured for storing the debris recovered through the recovery system and the suction nozzle.

* * * * *